United States Patent [19]

Vanderklaauw

[11] 4,251,974

[45] Feb. 24, 1981

[54] SENSING AND CONTROL APPARATUS FOR LIFTING HEAVY CONSTRUCTION ELEMENTS

[75] Inventor: Peter M. Vanderklaauw, 1450 Madruga Ave., Coral Gables, Fla. 33148

[73] Assignee: Peter M. Vanderklaauw, Coral Cables, Fla.

[21] Appl. No.: 33,053

[22] Filed: Apr. 25, 1979

[51] Int. Cl.[3] ..... E04G 21/14

[52] U.S. Cl. ..... 52/745; 52/126; 254/89 H

[58] Field of Search ..... 52/126, 745; 254/89 R, 254/89 H

[56] References Cited

U.S. PATENT DOCUMENTS

| | | | |
|---|---|---|---|
| 2,260,425 | 10/1941 | Widmayer | 52/324 |
| 2,540,679 | 2/1951 | Laffaille | 52/126 X |
| 2,715,013 | 8/1955 | Slick | 52/745 X |
| 2,867,111 | 1/1959 | Youtz | 52/126 |
| 2,975,560 | 3/1961 | Leonard | 52/126 |
| 2,975,650 | 3/1961 | Hollyday . | |
| 3,036,816 | 5/1962 | Stubbs et al. | 254/89 |
| 3,153,302 | 10/1964 | Wheeler | 52/745 X |
| 3,201,088 | 8/1965 | Long | 254/89 |
| 3,265,357 | 8/1966 | Schilling | 254/89 |
| 3,278,158 | 10/1966 | Saldana . | |
| 3,327,997 | 6/1967 | Zenke | 254/89 |
| 3,396,944 | 8/1968 | Jansz | 254/89 |
| 3,852,970 | 12/1974 | Cassidy | 52/126 X |
| 3,918,225 | 11/1975 | Fisher | 52/126 |
| 4,058,952 | 11/1977 | Donnelly | 52/741 |
| 4,074,474 | 2/1978 | Cristy | 52/126 X |

*Primary Examiner*—Alfred C. Perham

*Attorney, Agent, or Firm*—Kerkam, Stowell, Kondracki & Clarke

[57] ABSTRACT

The present invention relates to a jacking system for use in the construction of buildings or other structures in which accurate control and synchronization of lifting points is required. The system is mainly used in lift-slab and lift-plate construction with permanent or removable columns and features an arrangement of converging control wires which activate sensing apparatus. The sensing apparatus controls hydraulic pumps placed at each or plural lifting points.

6 Claims, 23 Drawing Figures

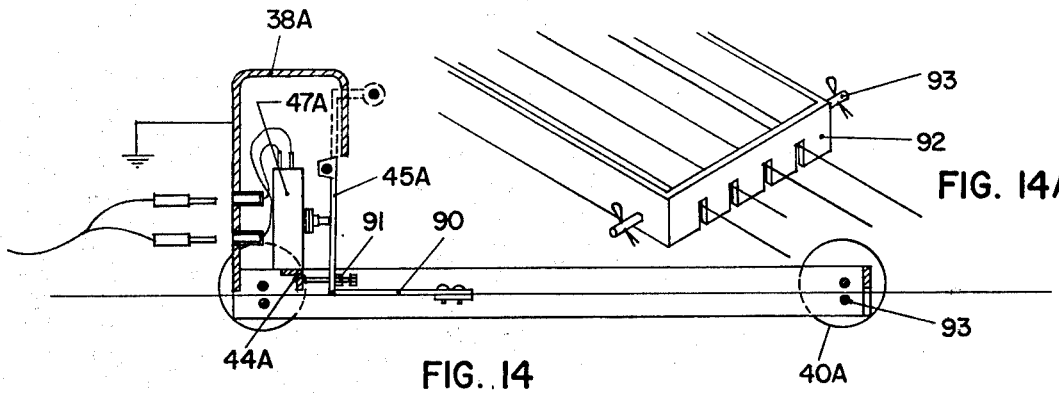
FIG. 14
FIG. 14A
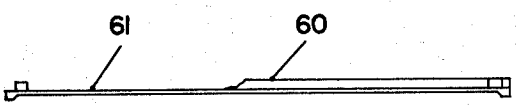
FIG. 15
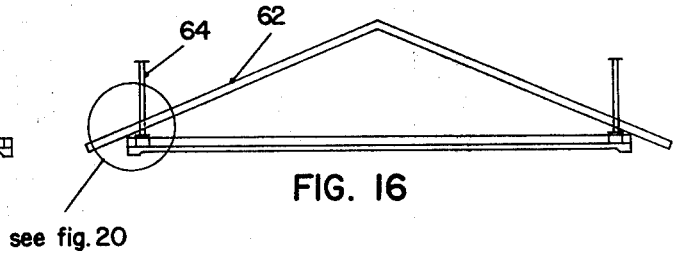
FIG. 16
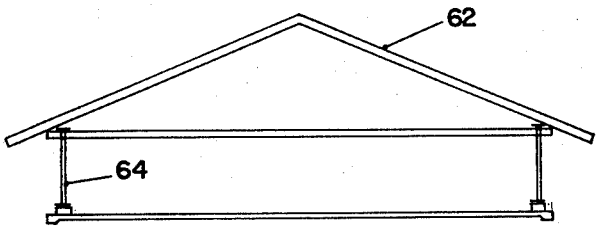
FIG. 17
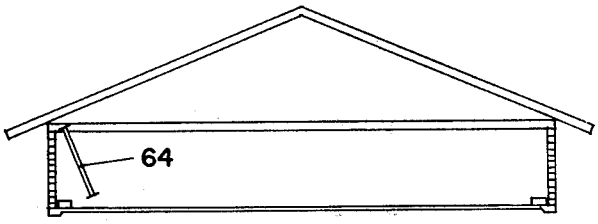
FIG. 18
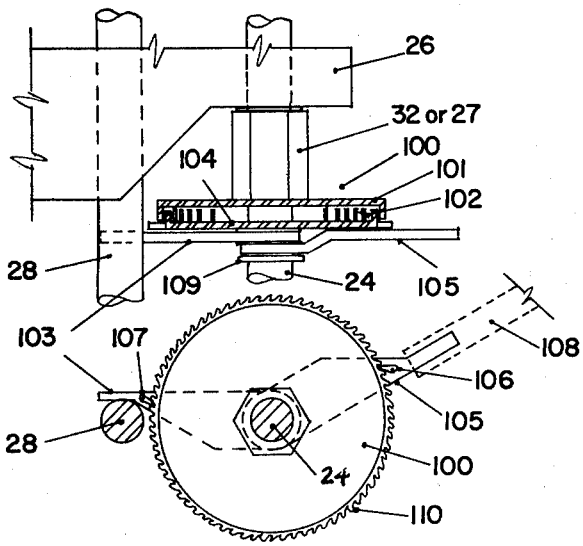
FIG. 19
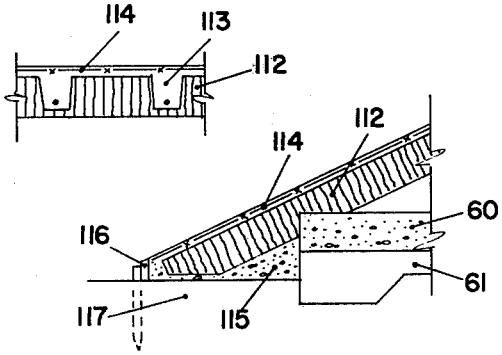
FIG. 20

SENSING AND CONTROL APPARATUS FOR LIFTING HEAVY CONSTRUCTION ELEMENTS

DESCRIPTION

Cross Reference to Related Application

Related subject matter is disclosed and claimed in my copending Application Ser. No. 948,168 filed Oct. 3, 1978 now U.S. Pat. No. 4,206,162.

Background Of Prior Art

Lifting buildings and parts of buildings has been done for many years, and there are many ways in which lifting is accomplished. Most systems have hydraulic jacks to provide the lifting force and wedges or screws to follow the movement upward ensuring that there is continuous mechanical support. Those systems are simple and powerful. This invention belongs in this category of lifting systems.

A serious problem in lifting large, heavy structures, especially concrete structures, is that all lifting points must rise at exactly the same rate of speed otherwise those structures become subject to unaccounted internal stresses and possible cracking or total failure.

Controlling the movement of lifting points has been done by simply placing a transit or builder's level in a stragetic location from which incremental movement is observed. The observer controls the jacks by snubbing hydraulic valves that are placed within his reach. Another means of controlling movement is by having a special hydraulic pump deliver the same amount of oil to the jacks at each lifting point.

Both methods are used extensively in the house raising and house moving business. They have also been used in liftslab construction, but in some cases with disasterous result because of inaccuracy in synchronization. A method now widely and successfully used in liftslab construction is a method patented by Marshall Long under U.S. Pat. No. 3,201,088. It has hydraulic jacks providing the lifting force. The oil feeding the jacks also feed small cylinders which turn steel nuts on threaded lifting rods. The movement of the nuts at each jacking point is controlled in a way that no new lifting cycle can begin unless all the nuts at all the lifting points have completed an incremental turn. The Long Method is accurate, dependable and fast. However, it has three distinct disadvantages: one is that the lifting apparatus is heavy and requires a crane for installation, another is that the equipment is placed on tops of columns out of direct visual control of the operator. A third disadvantage is that the equipment is complex and expensive and consequently only economical on large projects.

This invention seeks to eliminate these disadvantages.

BRIEF SUMMARY OF INVENTION

This invention has for its object to control the movement of hydraulic jacks by means of a sensing device or sensing devices which electrically control hydraulic pumps. A further object of this invention is to have the lifting mechanism at the operator's level, and light in weight so that it can be installed without the use of a crane. A still further object of this invention is to lift structures on temporary posts until bearing walls are installed. The intention is to bring down building cost. The various objects of this invention will be made more apparent through the following more detailed description and accompanying drawings.

BRIEF DESCRIPTION OF DRAWINGS

FIG. 14 is an alternative section through the center of the central sensing device of FIG. 8;

FIG. 14A is a partial perspective view of the FIG. 14 sensor frame;

FIGS. 15, 16, 17, and 18 are progressive diagrams of a roof constructed at ground level, raised on temporary steel posts and finally supported on exterior walls;

FIG. 19 shows a section and a top view of a spring loaded nut; and

FIG. 20 shows a sloping roof deck constructed at ground level and made of grooved rigid insulation panels upon which steel and concrete are placed.

DETAILED DESCRIPTION OF INVENTION

Figure 5:
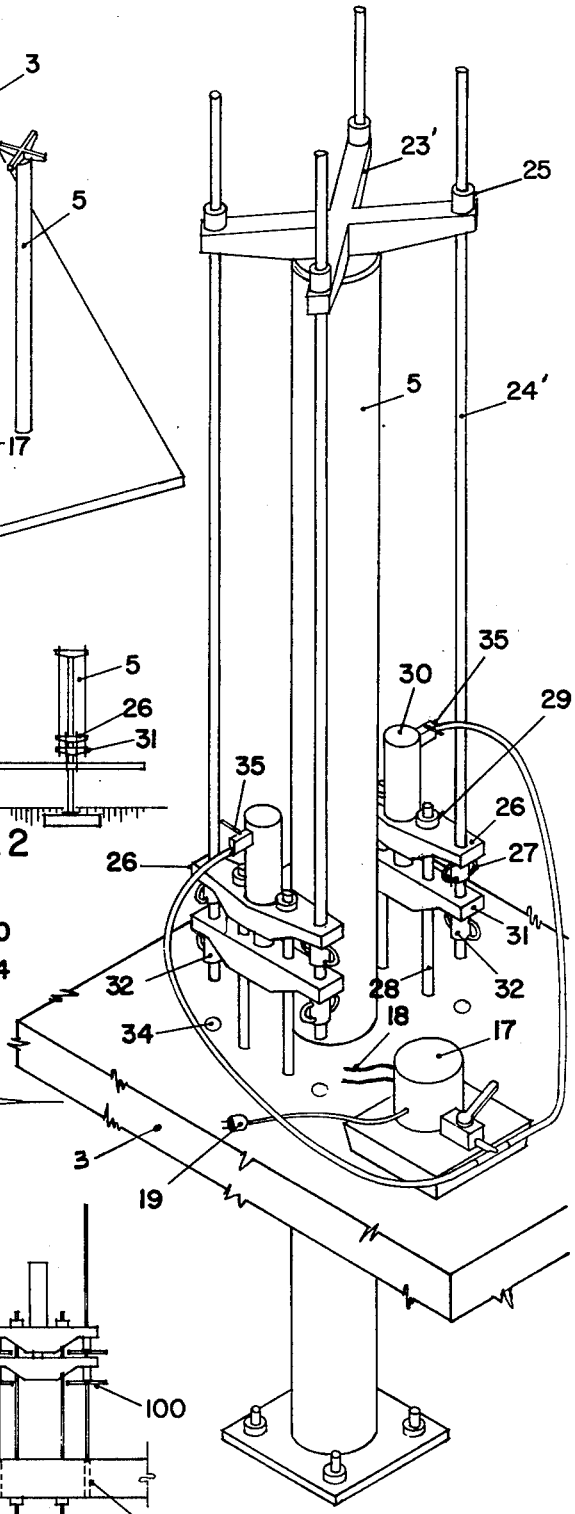
FIG. 5 is an isometric diagram of the lifting equipment.

Referring now to the illustrations and describing the construction method in more detail, the building process is started by casting one, two or more concrete plates 3, one on top of the other using a bond-breaking compound between them. When the plate 3 to be lifted has hardened, lifting equipment shown in FIG. 5 is installed at each post and control wires 1 are attached to the tops of the columns. The wires are laced through pulleys 2 which are attached to the concrete plate 3 near the column 5.

The wires pass through pulley block 4 which arranges them in a way that they run parallel towards the edge of the plate 3. At the edge of the plate 3 the wires 1 are pulled over another pulley block 6. At this point weights 7 are attached to the wires. Now it becomes quite apparent that when the plate is lifted, each wire moves across the floor. When they move at the same rate of speed, the plate 3 is lifted perfectly level. Before lifting, however, a bolt 8 is passed through the weights 7 attaching them one to the other secured by a nut 9. At this time each wire is under the same amount of tension. That tension in each wire will change when the lifting is not done in perfect unison.

Figure 3:
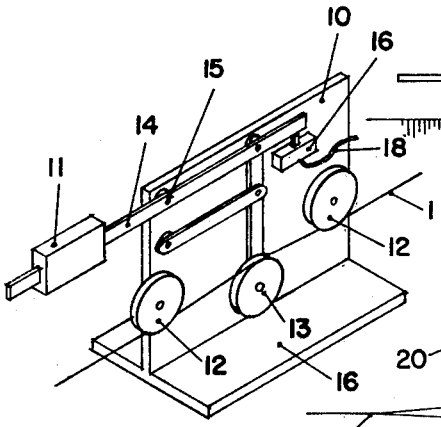
FIG. 3 is a detail of the sensing device shown in FIG. 1.

To monitor the change in tension, sensors 10, FIG. 3, are placed on the control wires 1, one at each column. A sensor consists of two idlers 12 and a dancer 13. Through a series of levers 14, which are hingedly attached to a frame 16, and a weight 11, the dancer exerts a constant lateral force on the wire running between the idlers. The levers 14 engage a micro switch 16 and that microswitch controls an electric pump. Lifting is started with all microswitches 16 engaged, in other words all the pumps 17 are running. If, in the course of lifting, one corner of the concrete plate 3 goes up faster than the remainder of the plate, the control wire running towards that corner will lose some of its tension. This causes the dancer 13 in the sensor in that corner to go up; the upward movement causes the limit switch 16 to disengage which in turn stops the pump 17. As soon as the other pumps have caught up, the tension in the subject control wire is restored, the dancer 13 goes down, the limit switch engages and the pump 17 starts running again. Thus, each pump 17 is switched on and off by the sensor that is placed close to it. The pump is energized through a wire 19 directly connected to a power source. There is a switching wire 18 connecting each of the pumps 17 to its sensor 10.

Figure 4:
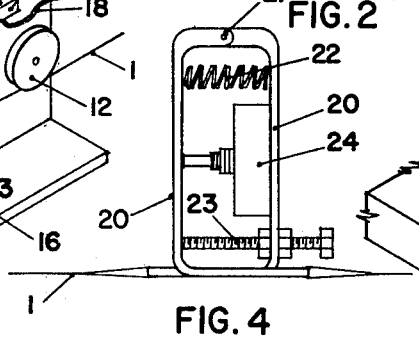
FIG. 4 is an alternate sensing device.

Instead of hanging the control wires over the edge of the plate, the same results can be obtained by winding the wires 1 on a revolving drum. The sensor shown in FIG. 3 is extremely accurate; however, money can be saved by using the sensor shown in FIG. 4 which has two arms 20 hingedly attached by a pin 21. The two arms 20 are attached to the control wires 1 and kept separated by a spring 22 and an adjusting screw 23. A microswitch 24 is placed between the arms 20. Under running conditions the arms 20 are held in closed position by the tension of the control wires 1. In this position the microswitch 24 is engaged. When the control wire slackens, the spring 22 forces the two arms to separate and to disengage the microswitch 24. This sensor is less accurate but adequate in certain instances.

Now referring to FIG. 5 and describing the lifting equipment, it consists of a spiderhead 23' mounted on top of the column 5 from which four threaded lifting rods 24' are pendingly attached by means of nuts 25. Supported by four wing nuts 27 are two pull plates 26. The pull plates 26 each have two pull rods 28 pendingly attached by means of nuts 29 which attach to the object to be lifted, plate mark 3 in this case. The pull plate 26 further has a hydraulic jack of which the cylinder attaches into a threaded hole in the center of the plate. Directly below the pull plate 26 there is a push plate 31 which rests on wing nuts 32. Lifting action starts by pumping oil to the jacks 30 causing the plunger to extend and the pull plate 26 to rise. Since the pull plate 26 is attached to the object to be lifted 3, that object rises as well. When the plunger reaches the end of the stroke wing nuts 27 are turned up to again support the pull plate 26 on the pending lifting rods 24. At this point the oil in the jacks is returned to the pump, and the push plate 31 follows the plunger of the jack upward until it is completely retracted.

Figure 6A:
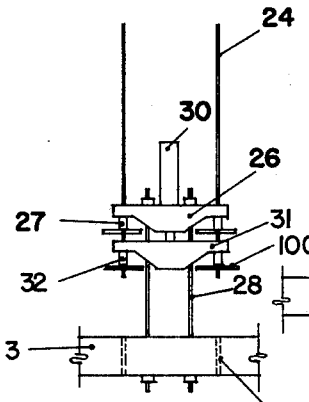
FIGS. 6A, 6B and 6C are progressive diagrams showing various steps in one lifting cycle.
Figure 6B:
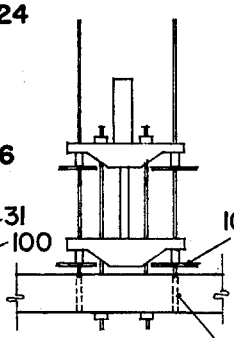
Figure 6C:
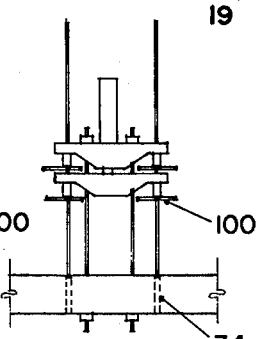

A new lifting cycle is started after the wing nuts 32 of the push plate 31 are turned up. FIGS. 6A, 6B and 6C show a diagram of the above described action. The nuts 27 and 32 may be turned by hand which has proved to be satisfactory when the threaded rods 24 have threads with a large pitch such as coil rods. However, there is a delay after each cycle when the nuts are being turned. That delay may be eliminated by using spring loaded nuts shown in FIG. 19. The nuts 27 and 32 in FIG. 19 have a round box or casing 101 attached to them containing a ribbon spring. That spring 102 is wound by a revolving plate 100 with a ratchet edge 110. Winding is done by swinging a lever arm 108 forth and back. The lever arm has a pawl 106 engaging the teeth of the ratchet. Preventing the revolving plate 100 from sringing back is a holding arm 103 resting against the pull rod 28. The holding arm has a pawl 107 also engaging the ratchet.

The nuts 27 and 32 are wound during lifting when manpower is available. They follow automatically when the pull plates 26 and the push plates 31 rise providing extra security in case of oil pressure loss. When the spring-loaded nuts are used the control valves 35 may be eliminated. Instead of winding the nuts with a lever arm and ratchet it is possible to provide the revolving plate with a bevel gear so a hand-held electric drill with a pinion in its chuck can be used for winding. Winding may also be done with an electric motor.

The objects to be lifted 3 must have holes 34 to allow the suspension rods 24' to pass through. The electrically operated hydraulic pump 17, FIG. 5, is designed to hold oil pressure when its stops. A safety valve 35 is mounted on each hydraulic jack 30. This safety valve allows the oil to pass in one direction, to the cylinder, when closed. The motor of the pump 17 is energized by a central source through a wire 19. There is also a switching wire 18 which goes to the previously described sensor.

Figure 1:
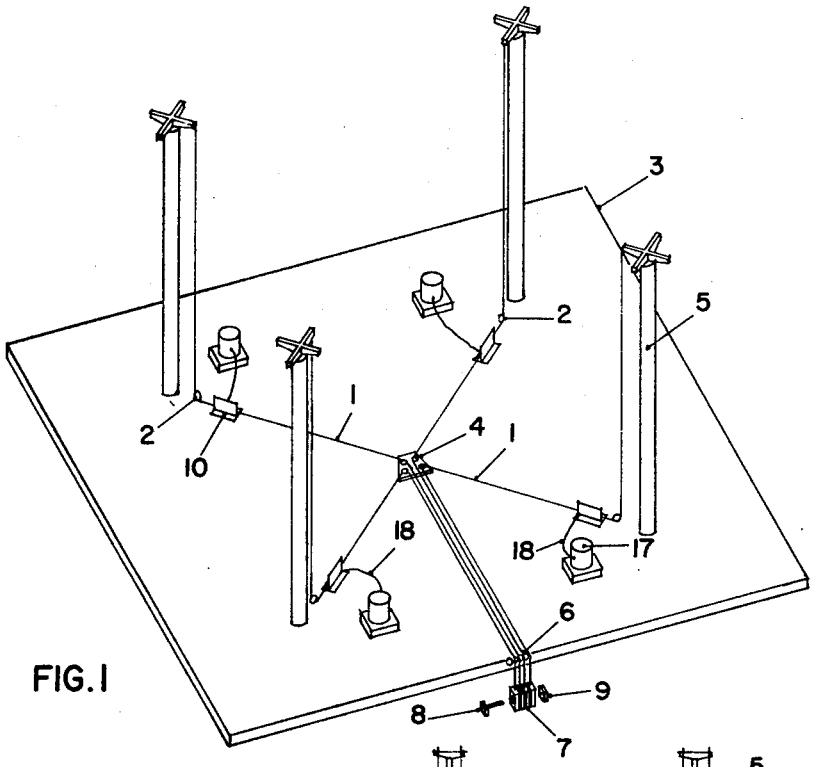
FIG. 1 is a diagram showing a concrete plate being lifted along steel posts with converging control wires passing through sensing devices. The lifting equipment is not shown for clarity.
Figure 2:
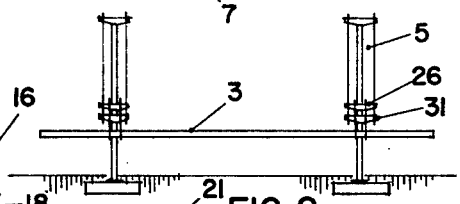
FIG. 2 is a section through the concrete plate of FIG. 1 and does show the lifting equipment.
Figure 7:
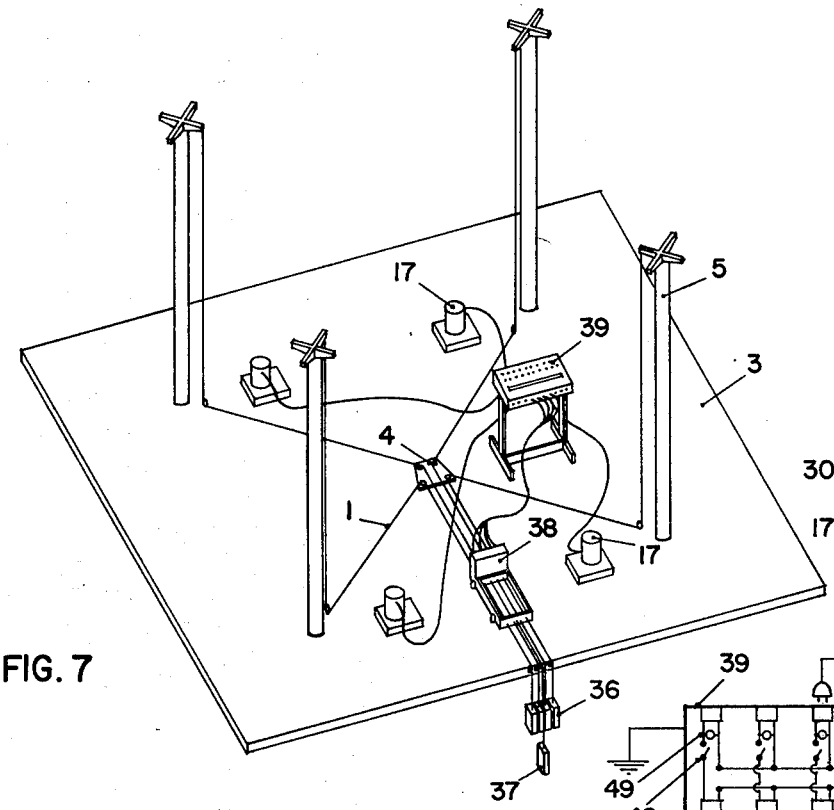
FIG. 7 is a diagram similar to FIG. 1 showing converging control wires but a single central sensing device.

Referring now to FIG. 7, it shows pulleys and wires as in FIG. 1. In this diagram, however, weights are not attached one to another, and there is a centrally located sensor 38 instead of independent sensors. It also shows a control panel 39. The centrally located sensors 38 is an improvement over the sensing devices 10 of FIG. 1 in that an operator can observe and control the actions of all pumps from one location.

Figure 8:
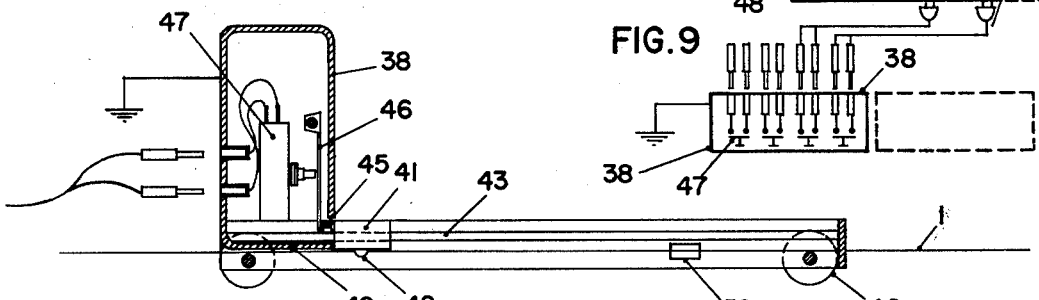
FIG. 8 is a section through the central sensing device.

The sensor of FIG. 8 has wheels 40 which enable the sensor to travel across the floor. It is placed over the control wires 1 in a way that the wires pass through the sensor 38. The control wires 1 are attached to slider blocks 41 by means of clamping screws 42. Slider blocks are mounted on tracks 43 enabling them to move from front to end. The sensor is pulled in the direction of the control wires by a weight 37 which hangs over the edge of the plate 3. The pulling action causes the slider blocks 41 to press against the body 49 of the sensor. In this position an adjusting screw 45 presses against a lever 46 which, in turn, engages a microswitch 47. Lifting action starts with all the microswitches engaged. If one of the jacking points rises too fast, the related slider block 41 will move forward in relation to the others and this causes the microswitch 47 to disengage.

Figure 9:
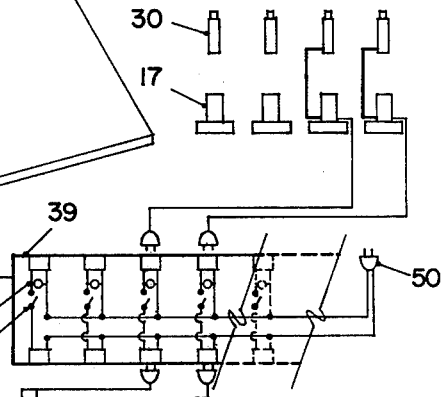
FIG. 9 is an electric/hydraulic diagram of the control system.

FIG. 9 is an electric/hydraulic diagram indicating the power supply 50 coming into the control panel 39 and feeding the electric pumps 17. The power supply to each pump is interrupted by the microswitches 47 located in the sensor and is further interrupted by a manual override switch 48 on the control panel. Pilot lights 49 indicate to the operator which pumps are running. Since pilot lights are often difficult to read in the bright sunlight, they can be replaced by low amperage motors which turn an indicator wheel. There is a danger that a control wire 1 may slip and move away from the slider block 41. To observe such happening, markers 52, FIG. 8, are attached to each control wire. They are placed in one line. One of the markers moving away from that line means there is a problem. The operator uses the manual override 48 to stop the pump related to that marker. Further, it would be simple to impose an alarm switch on the markers 52.

Figure 10:
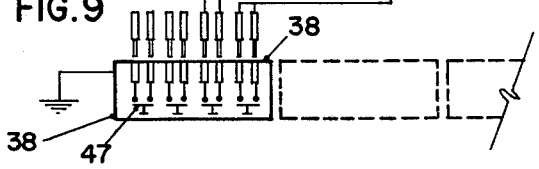
FIG. 10 is a diagram of an attachment to the sensor of FIG. 8, which attachment permits concrete plates to be warped or curved.
Figure 10:
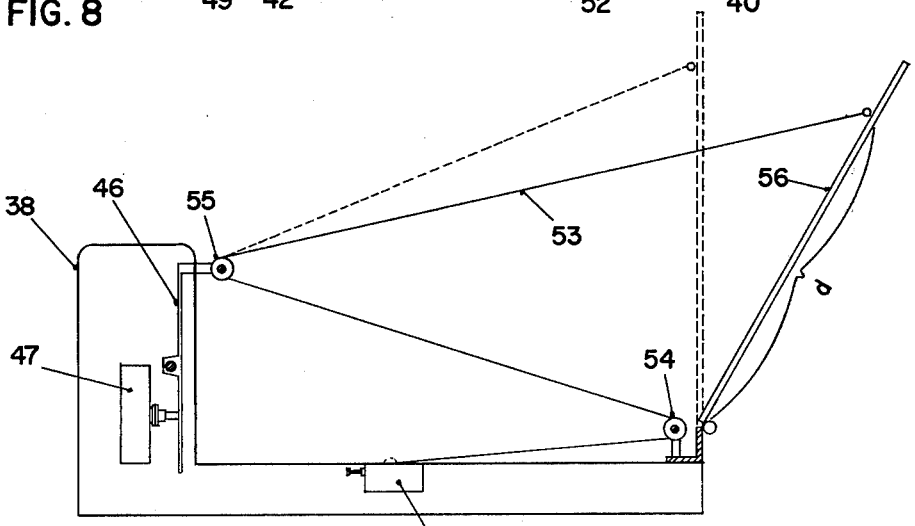

It is sometimes desirable to bring a concrete plate to a certain level and then slope it or warp it or curve it. As is the case on a warehouse roof to facilitate water runoff. This can be accomplished by an attachment shown in FIG. 10. It has a string 53 attached to each slider block 41 and passing through a pulley 54 attached to the sensor frame and a pulley connected to an extension of lever 46 which operates the microswitch 47. The string at the other end is attached to a program plate 56 which is hingedly attached to the sensor frame 38. The distance (d) to the program plate is predetermined for each lifting point and is equal to amount of extra lift that is required at each lifting point. Rotating the program plate 56 slowly causes microswitches 47 to engage and the jacks 30 to move gradually according to the program entered on the program plate 56.

FIG. 14 shows an alternate cross section of the sensor 38. The cross section is identical to the cross section shown in FIG. 8 except that instead of slider blocks 41, it has arms 90 that are hingedly attached to levers 45A on one end and clamped to the control wire 1 at the other end. It also has adjusting screws 91 attached to levers 45A and resting against the sensor frame 44A making it possible to make the increment of accuracy larger or smaller. The sensor 38A has wheels 40A.

FIG. 14A shows grooves in the end of the sensor frame which allows the sensor to be set over the control wires and removed. There is a keeper bar 93 to keep the control wires in the groove.

The fact that many lifting points can be accurately controlled encourages new approaches in construction such as shown in FIGS. 15, 16, 17 and 18. In this method a concrete plate 60, preferably reinforced with positioning steel, is cast at ground level on top of ground slab 61. Rafters and sheathing 62 are subsequently installed. When this roof assembly is complete, it is pulled up to rest on temporary steel posts 64. Bearing walls are subsequently installed and the posts 64 removed.

Figure 12:
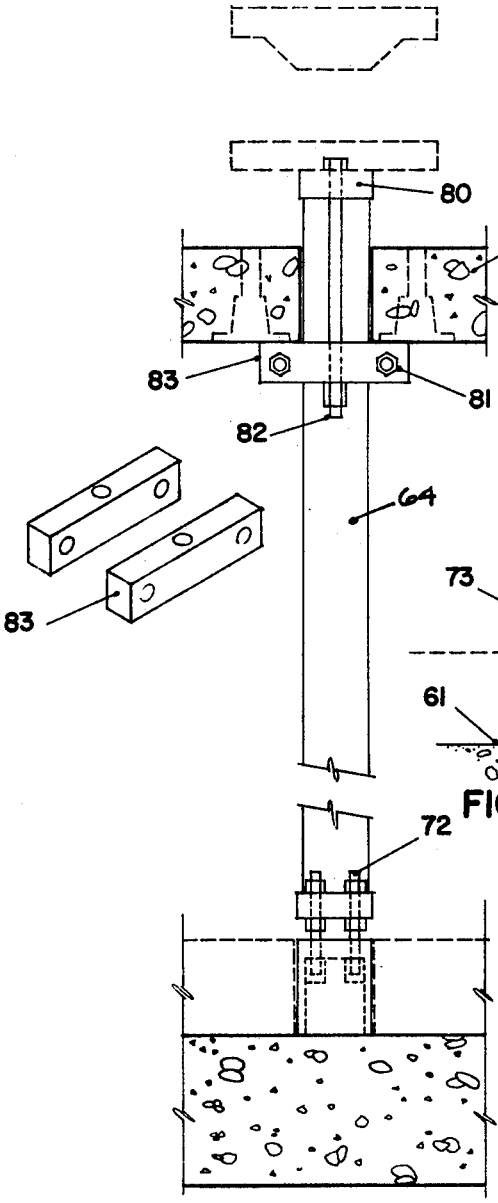
FIG. 12 is a frontal view of the temporary post of FIG. 11, with a concrete plate in lifted position.
Figure 13:
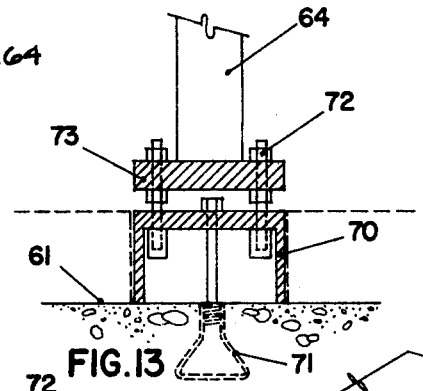
FIG. 13 is a section through the base shoe of the lifting equipment of FIG. 11.
Figure 11:
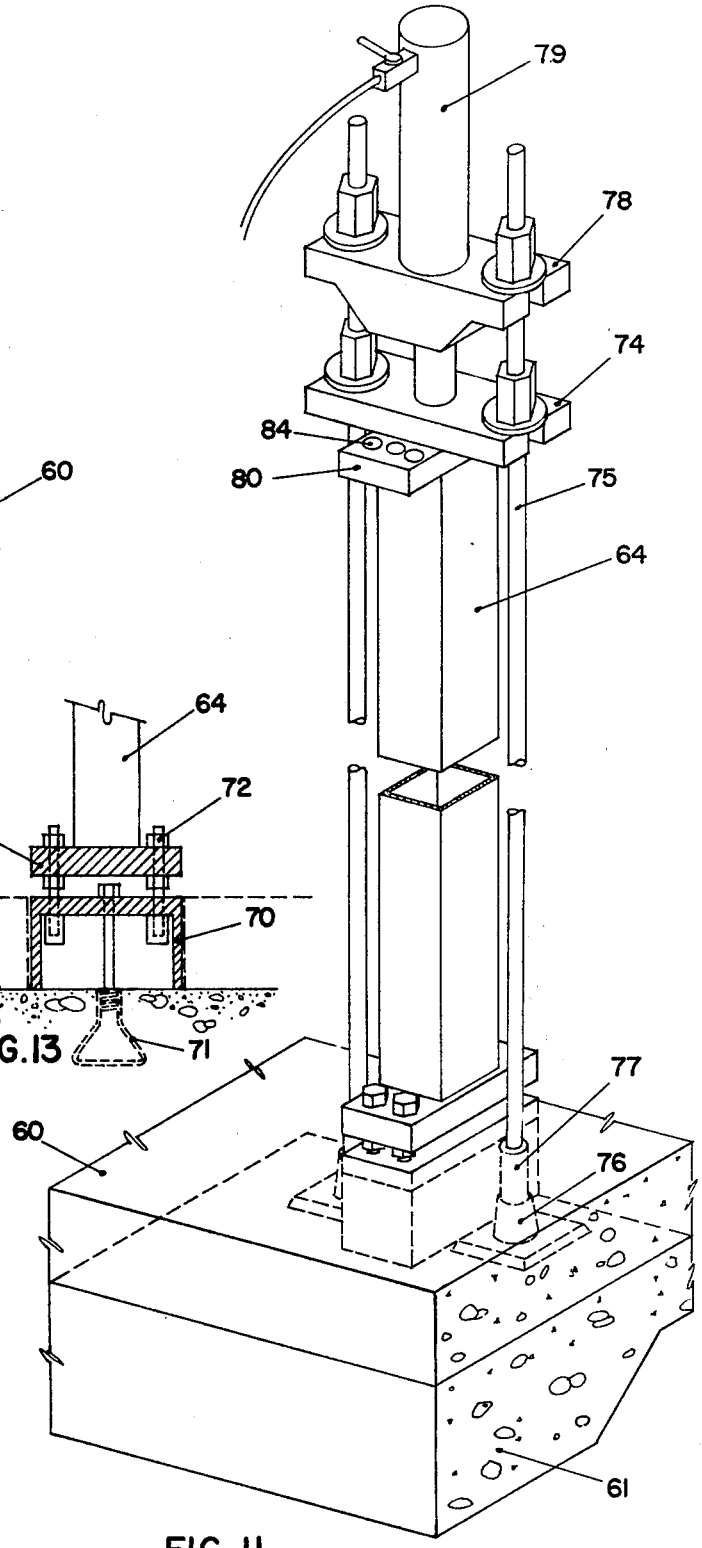
FIG. 11 is a detail of lifting equipment mounted on a temporary post.

The method is explained in more detail in FIGS. 11, 12 and 13. A base shoe 70 is attached to the previously poured slab 61 by means of bolt and insert 71. Four bolts 72 protruding from the base shoe are designed to support a temporary post 64. The temporary post 64 is plumbed by leveling three nuts under the base plate and adjusting them while tightening the nuts above the base plate. The nuts on the fourth bolt are tightened when the nuts on the other three bolts are tight. Mounted on top of the temporary column is a holding plate 74 from which two threaded lifting rods 75 are pending. Each lifting rod 75 has an anchor plate 76. This anchor plate 76 is tapered so as to facilitate release from the concrete when the concrete plate 60 is in its final position. Above the holding plate 74 is an assembly consisting of a pull plate 78 and a hydraulic jack 79. The assembly is identical to the jack and pull plate in FIG. 5 and can be used interchangeably. Lifting action is the same as the method described for FIG. 5 and needs no further description. When the concrete plate 60 reaches its final position, two collar bars 83 are clamped against the steel posts 64 and two bolts 82 passing through the top plate 80 of the temporary post 64 are attached to the collar bars 83. To remove the temporary post 64, after the bearing walls are in place, pending bolts 82 are first released, followed by the collar bars 80, then the nuts 72 of the base shoe. It should be readily understood that this temporary post system is not necessarily restricted to one-story buildings. The posts can be stacked and the floors poured on previously lifted floors. It should also be readily understood that the jacking assembly shown in FIG. 11, 74 and 78 can be used on permanent posts. In that case the anchor plates 76 would have flanges that enable them to be welded to the post 64.

Wood is becoming very expensive relative to steel and concrete. Therefore, instead of using wood rafters 62 it would be economical to use a concrete beam slab 114 for roof framing. As shown in FIG. 20, the beam slab would be formed by rigid insulation panels 112 having grooves 113 for the beams. The roof overhang is formed at ground level by an edge form 116 attached to the ground 117. Concrete is placed either by pouring or by spraying or shooting.

STATEMENT OF INDUSTRIAL APPLICATION

The present invention provides simple and inexpensive means for accurate control and synchronization of lifting points employed in jacking systems for use in construction of buildings wherein a substantial portion of the building construction is carried out at or adjacent ground level.

I claim:

1. A method of controlling the upward motion of heavy building elements by means of converging control wire comprising the steps:

casting and permitting to harden a plate to be lifted;

installing a plurality of vertical lifting post assemblies to the upper surface of the cast and hardened plate;

attaching a lift control wire to the tops of each lifting post assembly;

lacing each control wire through a pulley attached to the plate adjacent the bottom of each post assembly;

lacing each wire through a tension monitoring device and through a pulley block;

electric conductors connecting each monitoring device to electrically operated hydraulic pumps placed at each lifting post assembly;

causing said control wires to extend in parallel to one edge of the concrete plate;

attaching a tension weight to each control wire and thereafter attaching the weights together, whereby non-uniform lifting of the cast plate causes the tension in the wires to change and said change is sensed by the monitoring devices.

2. The method defined in claim 1 wherein the control wires are laced through a central sensing device which monitors the relative movement of each wire and activates pumps associated with each wire.

3. A method as set forth in claim 1 wherein lifting rods are pendingly attached to the tops of the post assemblies and wherein hydraulic jacks mounted in pull plates at the level of the operator pull the plate to be lifted along the lifting rods in a hand-over-hand fasion.

4. A method as set forth in claim 3 wherein safety valves mounted on the hydraulic jacks prevent the return of oil to the pumps in case of oil pressure loss.

5. A method as set forth in claim 3 wherein the pull plates are automatically followed by spring-loaded nuts to provide continuous mechanical support during lifting.

6. A method set forth in claim 3 wherein the pull plates are placed on top of posts and safety valves or spring-loaded nuts prevent plate fallback.

* * * * *